US009067702B2

(12) United States Patent
Scherl et al.

(10) Patent No.: US 9,067,702 B2
(45) Date of Patent: Jun. 30, 2015

(54) DEVICE AND METHOD FOR APPLYING ELASTIC FILM SLEEVES TO CONTAINERS

(75) Inventors: Stefan Scherl, Neunburg Vorm Wald (DE); Christian Holzer, Schierling (DE); Tino Sickert, Dresden (DE); Johannes Weiss, Nittenau (DE); Günter Frankenberger, Kofering (DE); Albert Heitzer, Bach (DE)

(73) Assignee: KRONES AG, Neutraubling (DE)

( * ) Notice: Subject to any disclaimer, the term of this patent is extended or adjusted under 35 U.S.C. 154(b) by 721 days.

(21) Appl. No.: 13/351,296

(22) Filed: Jan. 17, 2012

(65) Prior Publication Data

US 2012/0180431 A1 Jul. 19, 2012

(30) Foreign Application Priority Data

Jan. 17, 2011 (DE) ..... 10 2011 002 788

(51) Int. Cl.
*B65B 11/00* (2006.01)
*B65C 3/14* (2006.01)
*B65C 3/06* (2006.01)

(52) U.S. Cl.
CPC ..... *B65C 3/065* (2013.01)

(58) Field of Classification Search
CPC ..... B65B 21/00; B65B 21/24; B65B 21/245; B65B 21/247; B65C 9/00; B65C 9/0065; B65C 9/02; B65C 3/065; B65C 3/14
USPC ..... 53/441, 399, 135.1, 397, 415, 509, 585
See application file for complete search history.

(56) References Cited

U.S. PATENT DOCUMENTS

| | | | | | |
|---|---|---|---|---|---|
| 4,013,496 | A | * | 3/1977 | Amberg | 156/85 |
| 4,199,917 | A | * | 4/1980 | Mitchell | 53/441 |
| 4,286,421 | A | * | 9/1981 | Fujio | 53/399 |
| 4,514,953 | A | * | 5/1985 | Patzwahl | 53/52 |
| 4,620,888 | A | * | 11/1986 | Easter et al. | 156/64 |
| 5,398,395 | A | * | 3/1995 | Woolls | 29/417 |
| 5,433,057 | A | * | 7/1995 | Lerner et al. | 53/399 |

(Continued)

FOREIGN PATENT DOCUMENTS

| | | | |
|---|---|---|---|
| CN | 1297410 | A | 5/2001 |
| CN | 101276883 | A | 10/2008 |

(Continued)

OTHER PUBLICATIONS

Notification of the Second Office Action, The State Intellectual Property Office of P.R. China, Application No. 201210015358.2, dated Jun. 23, 2014.

(Continued)

*Primary Examiner* — Gloria R Weeds
(74) *Attorney, Agent, or Firm* — Marshall, Gerstein & Borun LLP

(57) ABSTRACT

A device and a method for applying elastic film sleeves to containers, including a plurality of revolving stretching units for receiving and stretching the film sleeves so that the containers can be slid into the film sleeves. The stretching units include spreading fingers driven by servo motors, such that the stretching of the film sleeves can be optimized independently of a circulation speed of the stretching units and flexibly adapted to different film types and container sizes.

21 Claims, 6 Drawing Sheets

(56) References Cited

U.S. PATENT DOCUMENTS

| | | | | |
|---|---|---|---|---|
| 5,483,783 | A * | 1/1996 | Lerner et al. | 53/399 |
| 5,501,065 | A * | 3/1996 | Fischer et al. | 53/535 |
| 5,577,365 | A * | 11/1996 | Reuteler | 53/398 |
| 5,715,651 | A * | 2/1998 | Thebault | 53/399 |
| 5,737,900 | A * | 4/1998 | Konstantin et al. | 53/295 |
| 6,845,600 | B2 * | 1/2005 | Hannen et al. | 53/459 |
| 6,925,777 | B2 * | 8/2005 | Fresnel | 53/399 |
| 6,978,819 | B2 * | 12/2005 | Tanaka et al. | 156/566 |
| 7,040,076 | B2 * | 5/2006 | Lachenmeier et al. | 53/441 |
| 7,060,143 | B1 | 6/2006 | Eiban et al. | |
| 7,156,140 | B1 * | 1/2007 | Houatchanthara | 156/521 |
| 7,204,908 | B2 * | 4/2007 | Houatchanthara | 156/264 |
| 7,398,811 | B1 * | 7/2008 | Duncan et al. | 156/392 |
| 8,020,601 | B2 * | 9/2011 | Eder et al. | 156/556 |
| 8,621,745 | B2 * | 1/2014 | Deonarine et al. | 29/775 |
| 2006/0213607 | A1 * | 9/2006 | Eiban et al. | 156/229 |
| 2007/0119542 | A1 * | 5/2007 | Williams et al. | 156/308.6 |
| 2008/0308235 | A1 * | 12/2008 | Ghini | 156/499 |
| 2010/0037556 | A1 * | 2/2010 | Fresnel | 53/218 |
| 2010/0071317 | A1 * | 3/2010 | Michels et al. | 53/441 |
| 2012/0180431 | A1 * | 7/2012 | Scherl et al. | 53/411 |
| 2012/0210673 | A1 * | 8/2012 | Schoenfelder | 53/111 R |
| 2013/0118136 | A1 * | 5/2013 | Arima et al. | 53/585 |
| 2013/0255885 | A1 * | 10/2013 | Carmichael | 156/538 |
| 2014/0048206 | A1 * | 2/2014 | Giuliani et al. | 156/293 |

FOREIGN PATENT DOCUMENTS

| | | | |
|---|---|---|---|
| CN | 101605697 | A | 12/2009 |
| DE | 29724886 | U1 | 4/2005 |
| EP | 1145967 | B1 | 9/2002 |
| EP | 2316738 | A2 | 5/2011 |
| FR | 2 631 924 | A1 | 12/1989 |
| JP | 2000190934 | A | 7/2000 |
| JP | 2000289715 | A | 10/2000 |
| JP | 2004-161281 | A | 6/2004 |
| WO | WO-00/66437 | A1 | 11/2000 |
| WO | WO-2007/060705 | A1 | 5/2007 |
| WO | WO-2008076718 | A1 | 6/2008 |

OTHER PUBLICATIONS

European Search Report for Application No. 11193772.8, dated May 24, 2012.

Search report for CN-2012100153582, dated Jan. 17, 2012.

* cited by examiner

DEVICE AND METHOD FOR APPLYING ELASTIC FILM SLEEVES TO CONTAINERS

CROSS-REFERENCE TO RELATED APPLICATION

The present application claims the benefit of priority of German Application No. 102011002788.2, filed Jan. 17, 2011. The entire text of the priority application is incorporated herein by reference in its entirety.

FIELD OF THE DISCLOSURE

The disclosure relates to a device for applying elastic film sleeves as well as to a corresponding method using the device, such as for beverage bottling operations.

BACKGROUND

One way of labeling containers, such as beverage bottles, for example, is by drawing tubular film sleeves over the container's outside surface. As an alternative to the heat-shrinking of film sleeves, which is described, for example, in WO 2007/060705 A1, elastically deformable film sleeves are being viewed with increasing interest due to the lower consumption of material and energy.

For example, WO 2000/066437 describes a method and a device for applying elastic film sleeves to containers. A film tube in a dispenser unit is hereby pulled over a central pin and the film sleeve is separated from the label tube at the required length and pulled, from the top, over two half-shell-shaped forceps halves. With these, the film sleeve can be stretched for the subsequent labeling, whereby a multiplicity of such units revolves on a labeling carousel. The forceps halves are thereby moved apart from one another with the help of a cam controller and the film sleeve is elastically stretched out so far that it can be pulled over a bottle provided below. The stretching devices are lowered for this purpose by cam-controlled lifting devices.

This device has the disadvantage, however, that the half-shell-shaped spreader forceps allow only a relatively minor stretching of the film sleeves and that the movements of the stretching devices and the bottle that is to be labeled are essentially accomplished by mechanical control cams that can only be adapted to different bottles and/or labels with a great effort. In this connection, WO 2000/66437 mentions only a motor-driven lifting support during the lifting/lowering of the stretching device in order to reduce its traversing times and minimize the dimensions of the device. In spite of this measure, however, the described method is suitable only for labeling essentially cylindrical outside surfaces and slightly varying bottle diameters.

For the labeling of curved outside surfaces with highly elastic film sleeves, WO 2008/076718 describes a device in which the half-shell-shaped forceps elements are replaced by a plurality of spreading fingers grouped circumferentially around a central opening and essentially running parallel to one another. The spreading fingers can be slid radially with respect to the central opening and can be moved apart from one another so far that a film sleeve drawn over the spreading fingers is stretched by the spreading fingers and a bottle that is to be labelled can be slid upwards through the central opening.

WO 2008/076718 furthermore describes that the film sleeve is first fixed in place by applying negative pressure on the suction openings provided in the spreading fingers, and can be repelled from the spreading fingers by subsequently applying a positive pressure so that during the further advancing of the bottle to be labeled, a transfer of the film sleeve from the spreading fingers to the bottle results. The radial movement of the spreading fingers is hereby triggered by a rotatable control disc with curved guide grooves for control cams provided on the spreading fingers. A pneumatically or electromechanically controlled actuator arm is suggested as the drive for the control disc. WO 2008/076718 leaves open, however, how such a comparatively complicated drive for the control disc could look. Only cam-controlled control discs are known from commercially available variants of the device described in WO 2008/076718.

Consequently this device also has the disadvantage that an adjustment of the stretching unit to different film sleeves and/or bottles is possible only with a great apparatus-based effort. In other words, numerous mechanical components would have to be interchanged for this purpose. This necessitates not only a high financial expenditure for the provision of the different system components, but also a comparatively long production standstill during the changeover of the labeling machine. Furthermore, the cam controller of the stretching unit known in the state of the art has the disadvantage that the time sequence of the label dispensing and the label stretching is tied to the circulation speed of the stretching units. This means that when there is a change in the machine performance of the labeling device, there is a change in the time sequence of the receiving, stretching and peeling of the film sleeve, as a result of which correct labeling is no longer guaranteed. Devices from the state of the art work in a performance-dependent manner, i.e., they are consequently dependent on the machine speed.

There is consequently a need for a device for applying elastic film sleeves to containers that is improved in this respect, as well as for a correspondingly improved method.

SUMMARY OF THE DISCLOSURE

With the present disclosure, at least one servo motor drive per stretching unit is provided for producing at least a relative movement with respect to the film sleeve and container in the radial and/or axial direction. In particular, revolving stretching units are provided that comprise at least one servo motor for driving the spreading fingers provided on the stretching units. The stretching units hereby preferably revolve with a labeling carousel. The stretching units are consequently not driven indirectly by the labeling carousel, such as in the case of a cam controller, for example. The drive of the labeling carousel and the stretching units can instead be decoupled from one another. This makes it possible to increase the flexibility of the device. The individual stretching units can also be driven independently of one another by separate servo motors.

An especially advantageous embodiment comprises a control device for activating the at least one servo motor in order to move the spreading fingers between an inner receiving position for receiving the film sleeves and an outer spreading position for stretching the film sleeves, whereby particularly the outer spreading position and/or the inner receiving position is adjustable. In this way, the device can be adapted in a simple way to different container sizes, particularly container diameters, and/or to different film types, particularly with different elastic ductility. In particular, a ratio of the length of an intended circumferential line around the spreading fingers in the spreading position and in the receiving position can be adjusted. The ratio can, for example, be at least 1.2, particularly at least 1.5. This allows flexible optimization of the stretching of the film sleeve.

With the help of the servo motors, the spreading fingers can be driven back and forth between flexibly adjustable inner and outer end positions within a stipulated adjusting range of the stretching units depending on the diameter of the container that is to be labeled and/or the film sleeve that is to be applied. In particular, the inner receiving position can be adapted to the diameter and/or the length of the unstretched film sleeve and the outer spreading position can be adapted to the ductility of the film sleeve and/or to the diameter of the container that is to be labeled.

A preferred embodiment of the device according to the disclosure furthermore comprises a control device that is formed for activating the at least one servo motor in such a way that at least a switching-on time and/or an positioning speed of the at least one servo motor can be adjusted with the help of the control device, particularly in order to move the spreading fingers away from one another. In this way, the movement of the spreading fingers can be adapted to the label dispenser independently of the circulation speed and/or the circulation position of the stretching units. The time sequence of the receiving, alignment and/or stretching of the film sleeve can consequently be optimized. In particular, a correct alignment of the film sleeve on the spreading fingers can also be ensured in the event of changing machine performances.

The spreading fingers can also already be moved apart from one another before the film sleeve has reached its vertical target position on the stretching unit. In this way, the centring of the film sleeve with respect to the spreading fingers can be improved and/or a coaxial alignment with respect to one another can be ensured. In particular, the time coordination of the shooting of the film sleeve and the driving apart of the spreading fingers can also be optimized in the case of changing machine performances. To be understood as the circulation speed hereby is, for example, the track speed of the container area of the stretching units, and the circulation position of the stretching units is to be understood, for example, as a rotation angle position on a labeling carousel.

Furthermore, revolving positioning units are preferably provided on the device according to the disclosure below the stretching units for positioning the containers in the container areas of the stretching units, whereby each of the positioning units particularly comprises lifting devices driven by servo motor for lifting the containers into the container areas. This makes a lifting/lowering of the stretching units dispensable. The lift of the lifting devices can be flexibly adapted to the size of the containers with the help of servo motors.

Preferably an upper end position of the positioning units can be adjusted for aligning the containers with respect to the label sleeves, particularly in steps of not more than 1 mm. Particularly advantageous are steps of not more than 0.5 mm. In this way, containers of different sizes can be positioned optimally in the container areas with respect to the stretching units and the film sleeves. The final labeling position of the film sleeves on the container can consequently be flexibly adjusted and readjusted as needed.

A preferred embodiment of the device according to the disclosure furthermore comprises removal units, revolving above the stretching units, for removing the containers from the container areas, whereby each of the removal units particularly comprises lifting devices, driven by means of a servo motor, for lifting the containers out of the container areas. The removal units and the stretching units hereby preferably revolve around a common axis of rotation. A lifting or lowering of the stretching units is consequently also dispensable during the removal of the labeled containers. The lift of the removal devices can, with the help of servo motors, be flexibly adapted to the size of the containers that are to be labeled. In particular, a lower gripping position for gripping the labeled containers can also be adapted to the container size without the interchange of mechanical guides and/or control elements, such as lifting cams, for example. The positioning speed of the lifting device can likewise be adapted to the respective time sequence of the label transfer from the spreading fingers to the containers. For example, the positioning speed of the lifting device can be adapted in order to bring about a required frictional connection between the film sleeve and the container, particularly in order to adapt a holding force of the frictional connection and/or the time of the start of the frictional connection.

A preferred embodiment of the device according to the disclosure furthermore comprises revolving valve units for switching on a negative pressure or a positive pressure on the spreading fingers in an alternating manner, in order to draw the film sleeves to the spreading fingers or repel them from the spreading fingers. The valve units are thereby set up to provide the negative pressure or the positive pressure to the stretching units independently of one another. The valve units and the stretching units preferably revolve around a common axis of rotation, particularly on a common labeling carousel. As a result of the fact that the valve units circulate with the stretching units, the pressure lines between the valve units and the spreading fingers can be formed in an especially simple manner. As a result of a separate supply of negative pressure or positive pressure to individual stretching units, the transfer of the film sleeves from the spreading fingers to the containers can be controlled with special precision. An embodiment in which each valve unit is assigned to a plurality of stretching units is especially economical and space-saving. The valve units can consequently comprise a plurality of valves or valve groups, whereby valves assigned to different stretching units can be switched separately from one another.

The switching times of the positive pressure and/or negative pressure are preferably adjustable, and in particular, a switching time of the negative pressure can be synchronized with the activation of the servo motor of the assigned stretching unit. In this way, the suctioning of the film sleeves to the spreading fingers and/or the repelling of the film sleeves away from the spreading fingers can be adapted to different machine performances. The transfer of the film sleeves to the spreading fingers and from the spreading fingers to the containers can consequently be controlled essentially independently of the circulation speed of the stretching units. In particular, in interaction with the variably adjustable driving apart of the spreading fingers, the alignment and fixing in place of the film sleeve on the spreading fingers can be particularly precisely and flexibly adjusted with the help of the individual negative pressure controller. Synchronization is hereby to be understood as a coordination of the switching times of the valve units and the servo motor and/or of the positioning speed of the servo motor.

Preferably the switching-on time of the positive pressure can be synchronized with the removal units. Synchronization is hereby particularly meant to be a coordination in time of the valve units and the lifting movement of the removal units. The switching-on time of the positive pressure can hereby be adapted both to the switching-on time of the servo motor of the lifting device and also to the positioning speed of the servo motor. The time at which the static friction between the spreading fingers and the elastic film sleeve is consequently reduced with the help of an air cushion caused by the positive pressure can consequently be adapted to the lifting movement of the lifting device.

The valve units preferably comprise Venturi nozzles for producing the negative pressure. Venturi nozzles or comparable flow channels that work according to the Venturi principle allow the production of the negative pressure within the valve units by means of feeding a positive pressure. A separate pressure line on the input side for providing a negative pressure at the valve units is consequently dispensable. The valve units are preferably connected to a central media distributor in order to supply the valve units with compressed air. The valve units are set up in order to conduct compressed air selectively either to the stretching units or to the Venturi nozzles. The valve units consequently have, per stretching unit, at least three switch positions, namely a first switch position in which the stretching units are supplied with neither positive pressure nor with negative pressure, a second switch position in which the stretching units are supplied with the negative pressure, and a third switch position in which the stretching units are supplied with the positive pressure.

An especially advantageous development of the device according to the disclosure furthermore comprises at least one label dispenser or the like for equipping the stretching units with the elastic film sleeves. The label dispenser is preferably stationary and arranged above the circulating path of the stretching units. The stretching units can consequently be continuously moved through the area below the label dispenser. The label dispenser is hereby preferably arranged centred above the circulating path of the stretching units in order to simplify the most coaxial shooting possible of the film sleeve on to the spreading fingers.

Each of the stretching units preferably comprises exchangeable fitting units with at least the spreading fingers and a guide plate for guiding the spreading fingers. The device can be adapted to different containers and/or film sleeves in an especially economical manner by means of interchanging the fitting units. For example, the fitting units can differ from one another by having spreading fingers with different lengths or different shapes and/or by different radial adjustment ranges of the spreading fingers. In this way, different inner receiving positions and/or different outer spreading positions of the spreading fingers can be implemented. It would also be possible to provide fitting units with a different suction and/or repelling function. For example, the number and/or position of the pressure conduit openings on the spreading fingers can be varied from fitting to fitting. The flexibility of the device according to the disclosure can consequently be further increased without it being necessary to interchange the supplying valve units and/or the servo motors of the stretching units. The flexibility is further increased by means of it being possible to adapt the activation of the valve units and/or the servo motors to the respective fitting unit by means of suitable programming.

Exchangeable adapter pieces are preferably provided on the outer sides of the spreading fingers, particularly for adapting the spreading fingers to film sleeves of a stipulated length. The stipulated length of the film sleeves normally differs from the length of the spreading fingers and is, in particular, greater than the length of the spreading fingers. By interchanging the adapter pieces, the device according to the disclosure can be adapted to different film sleeves in an especially simple manner.

The method according to the disclosure includes: a) Receiving the film sleeves with the stretching units; b) Stretching the film sleeves in such a way that the containers can be slid into the film sleeves; and c) Sliding the containers into the film sleeves, whereby the stretching of the film sleeves and/or the relative axial movement of the container and film sleeve preferably takes place in a manner that is constant in time. The use of the device according to the disclosure consequently allows the provision of an especially flexible labeling of the containers. The method according to the disclosure can furthermore comprise a step d) for removing the containers that have been provided with the film sleeves.

An especially preferred variant of the method according to the disclosure furthermore comprises in step a) an alignment step a1) in which the spreading fingers are moved away from one another and then back towards one another at least one time in order to align the position of the film sleeve with respect to the spreading fingers. With the help of the alignment step, a film sleeve that possibly sits diagonally on the spreading fingers can be radially repelled in order to achieve an essentially coaxially aligned position of the film sleeve with respect to the spreading fingers. In the alignment step, the spreading fingers are driven at least so far apart from one another that at least one spreading finger comes into contact with the film sleeve, so that a radial repelling movement is carried out. It would also be conceivable in the alignment step hereby to move the spreading fingers apart and back towards one another a plurality of times in order to shake the film sleeve into a required position with respect to the spreading fingers. It would also be conceivable only to interrupt the spreading movement in the alignment step a1).

The spreading fingers are preferably moved in at least one of the steps a) to c) depending on an adjustable time interval, whereby its beginning is coupled in particular to a time of the dispensing of the film sleeves. By means of such a time-dependent control, for example, triggered by a switching process in the label dispenser, the movement of the spreading fingers can be synchronized with the movement of the film sleeves during dispensing independently of the circulation speed of the stretching units. Synchronization of the movement of the spreading fingers with a provision of negative pressure and/or positive pressure to the spreading fingers is likewise possible in this way. The movement of the spreading fingers can also be synchronized in a time-controlled manner with a switching process for lifting the container out of the stretching units.

BRIEF DESCRIPTION OF THE DRAWINGS

A preferred embodiment of the disclosure is shown in the drawing. Shown are.

DETAILED DESCRIPTION OF THE PREFERRED EMBODIMENT

Figure 1:
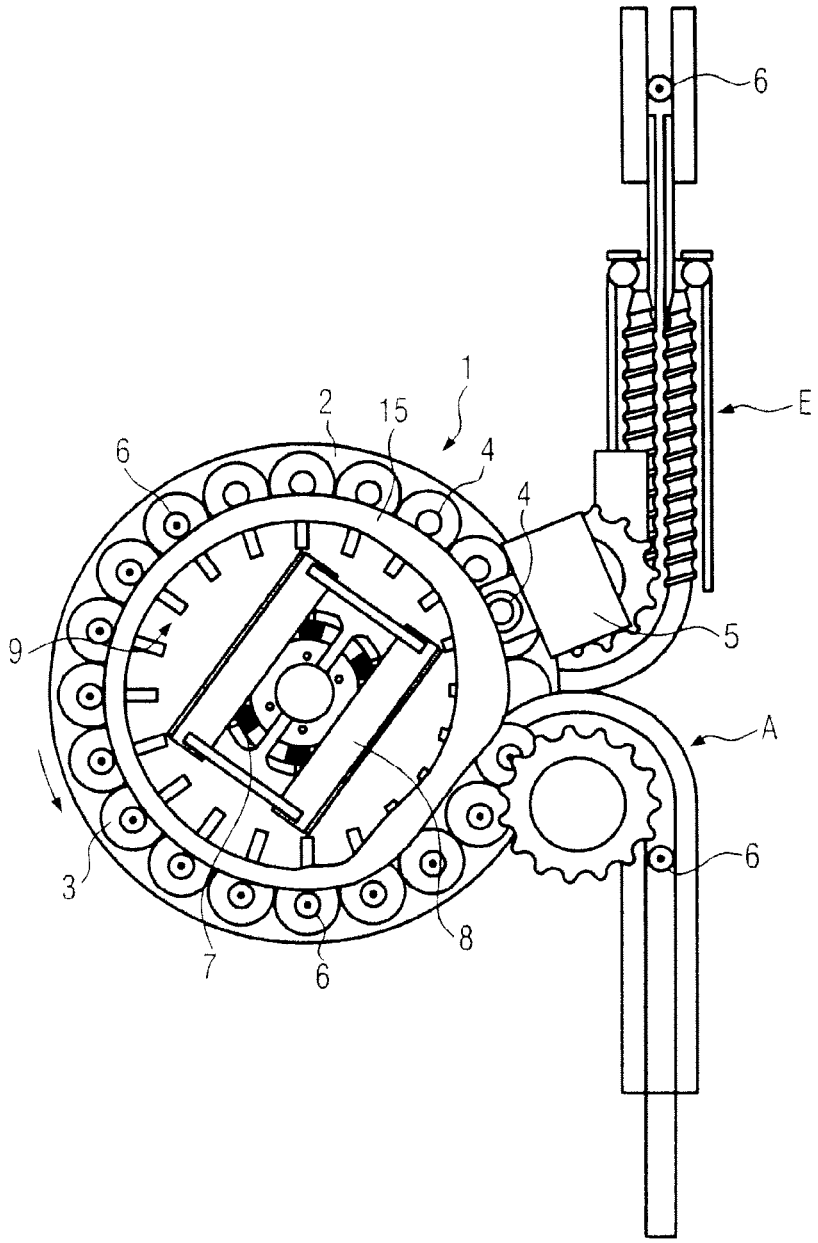
FIG. 1 a top view on to the preferred embodiment of the device according to the disclosure.

As can be seen in FIG. 1, the preferred embodiment of the device 1 according to the disclosure is designed as a rotary table-type machine. The device 1 accordingly comprises a labeling carousel 2 with stretching units 3, uniformly distributed on the circumference thereof, for receiving and stretching flexible film sleeves 4 that are separated from a film tube (not shown) by a stationary label dispenser 5 of a known construction and shot on to the stretching units 3 from above.

Figure 6:
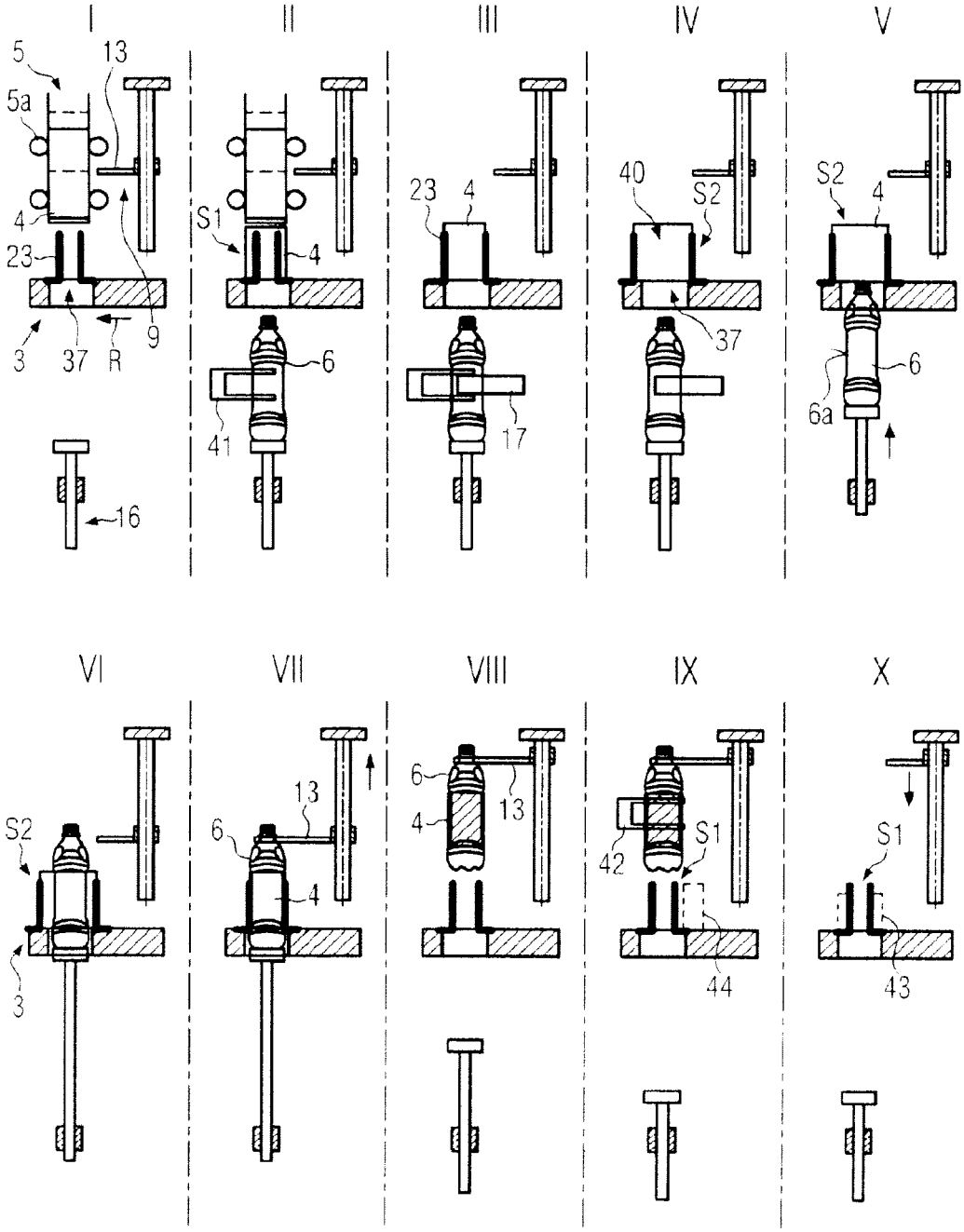
FIG. 6 a schematic depiction of the method according to the disclosure.

The interaction of the label dispenser 5, the film sleeves 4 and the stretching units 3 is indicated schematically in FIG. 6. FIG. 1 furthermore shows an inlet area E for feeding containers 6 that are to be labeled, as well as an outlet area A for removing the containers 6 that have been labeled with the film sleeves 4.

Valve units 7 are mounted on the labeling carousel 2 in such a way that they also rotate, in order to supply the stretching units 3 selectively with air suction or with compressed air. The valve units 7 preferably comprise Venturi nozzles (not shown) or the like in order to produce negative pressure for suctioning to the stretching units 3 by means of introducing compressed air into the valve units 7 at the Venturi nozzles. The valve units 7 are consequently to be provided only with compressed air on the input side in order selectively to provide compressed air or negative pressure at the output side for operating the stretching units 3. The compressed air is preferably provided via a central media distributor of the labeling carousel 2. It shall be understood that the valve units 7 have a switch position in which these supply the stretching units 3 neither with positive pressure nor with negative pressure.

A number of valve units 7 that are supplied could correspond to the number of stretching units 3. Advantageous, however, are valve units 7 with a plurality of valves or valve groups, each assigned to individual stretching units 3, so that a valve unit 7 can supply a plurality of stretching units 3 independently of one another. It is crucial for the feed of compressed air or the feed of negative pressure to be separately switchable for each stretching unit 3. The individual stretching units 3 are correspondingly connected to the valve units 7 via separate pressure lines. The valve units 7 are activated by a control unit 8 that preferably has a stationary mounting in an area above the labeling carousel 2.

Figure 2:
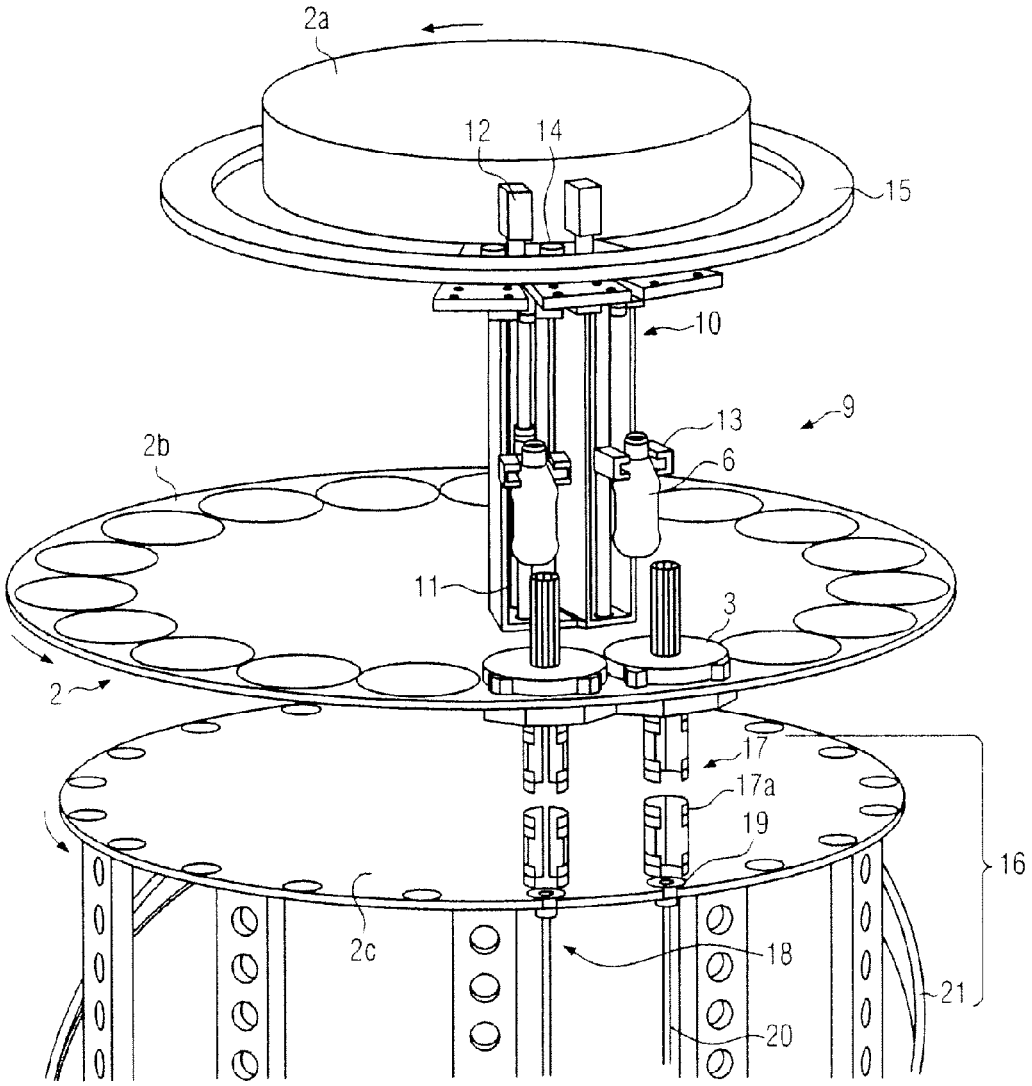
FIG. 2 a side view of a labeling carousel provided on the device according to the disclosure.

Each stretching unit 3 is assigned a removal unit 9 in order to remove the labeled containers 6 from the stretching units 3. The removal units 9 can also support the process of pulling the film sleeves 4 on to the containers 6 in a subsequent labeling phase, for example, by means of clamping the film sleeves 4 in the neck area of the container 6. The configuration and functioning of the removal units 9 are made clear particularly in FIG. 2, which shows the labeling carousel 2 with schematically indicated assembly platforms 2*a* to 2*c*, which rotate with the carousel, in a diagonal view, whereby for the sake of simplicity, only two stretching units 3 are shown with the assigned removal units 9 in an identical operating position.

Each of the removal units 9 accordingly comprises an upper lifting device 10, for example, comprising a threaded spindle 11 and a servo motor 12 for driving the upper lifting device 10. Each lifting device 10 is used for lifting and lowering a gripping device 13 that, for example, comprises a switchable clamp in order to grip the labeled containers 6 in their neck area and/or shoulder area. It shall be understood that the gripping devices 13 are formed in such a way that the labeled containers 6 can be transferred to a suitable transport device in the outlet area A. The gripping devices 13 can preferably be switched via cam rollers 14, indicated only schematically, and at least one control cam 15.

A positioning unit 16 is provided below each of the stretching units 3 in order to receive the containers 6 that are to be labeled, to lift them in a guided way and to slide them into the stretching units 3 from below. For this purpose, a preferably switchable container guide 17 is provided on the positioning units 16, as is a lower lifting device 18 that can, for example, comprise a support plate 19, a plunger 20 and a cam roller (not shown) that runs along a control cam 21 for activating the plunger 20.

The lower lifting devices 18 are preferably formed in such a way that they support the bottoms of the containers 6 that are to be labeled so that the containers 6 can be slid along each of the assigned container guides 17 when the lower lifting devices 18 are activated. These container guides are preferably provided with switchable clamps 17*a* that first fix the containers 6 in a closed position after the transfer to the labeling carousel 2 and release the containers 6 in the vertical direction immediately before the activation of the lower lifting devices 18, so that the containers 6 can be lifted in the direction of the stretching units 3.

As an alternative to the cam control of the positioning units 16 shown, a drive of the lower lifting devices 18 is conceivable by means of separate servo motors (not shown) analogously to the drive of the upper lifting devices 10. In this case, the servo motors of the lower lifting devices 18 would preferably be activated by means of the control unit 8. A servo motor drive of the lower lifting devices 18 offers the advantage that its upper end position, and therefore the vertical position of the container 6 during labeling in the stretching unit 3, can be flexibly adjusted with the help of a suitable activator. In this case, the vertical container position can be given in small steps or readjusted as needed, for example, in steps of less than 1 mm or in particular of less than 0.5 mm. This allows an optimization of the labeling position with respect to the container 6.

Figure 3:
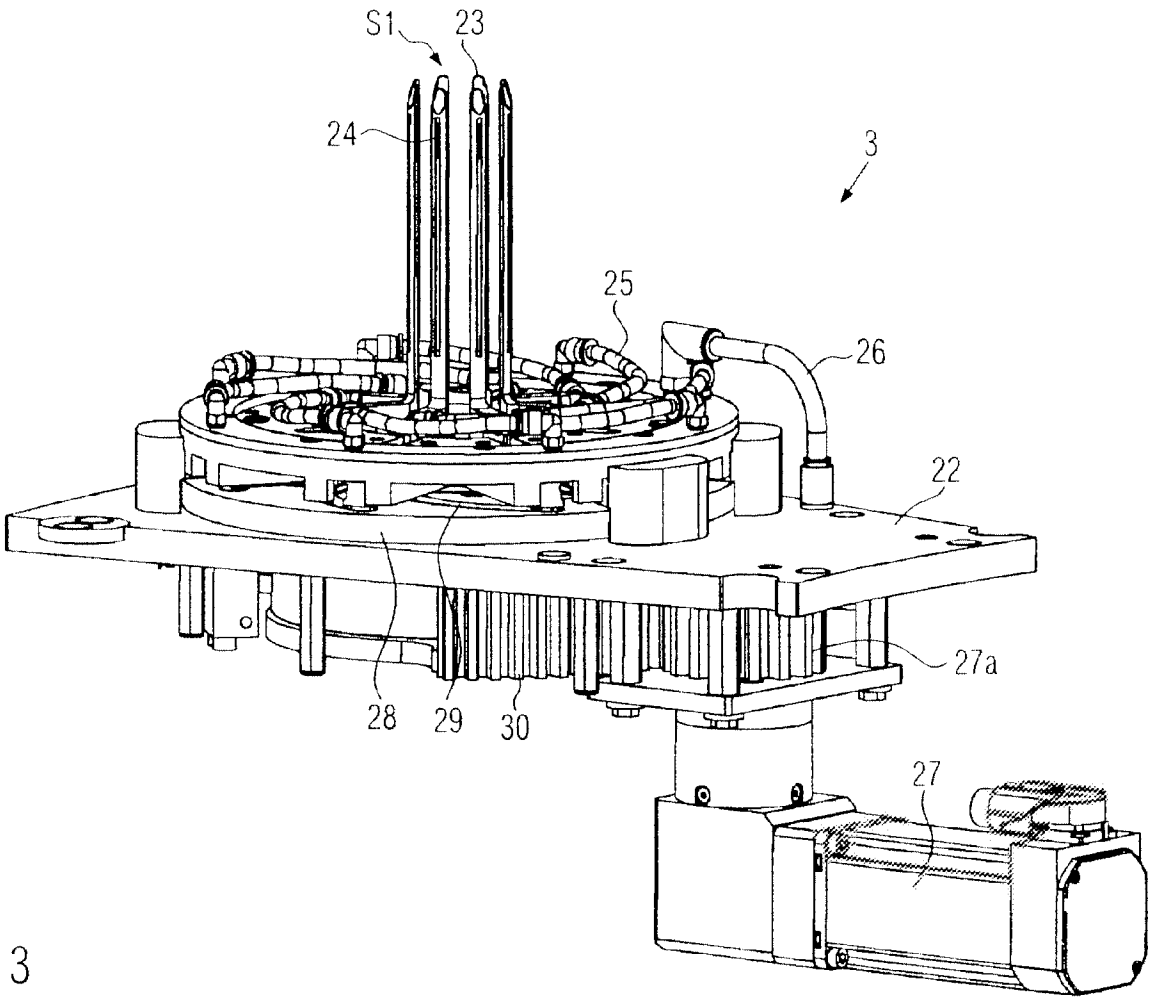
FIG. 3 a side view of a stretching unit according to the disclosure.

FIG. 3 illustrates the configuration of the stretching unit 3. This accordingly comprises a base plate 22 for attachment of the stretching unit 3 on the labeling carousel 2. The stretching unit 3 furthermore comprises spreading fingers 23 that can be displaced laterally, particularly radially, for receiving and stretching the film sleeve 4. For drawing in or repelling the film sleeve 4, openings 24 are provided on the outer sides of the spreading fingers 23, whereby these openings 24 are connected to each of the assigned valve units 7 via suitable pressure conduits (not shown) in the spreading fingers 23 and pressure lines 25, 26.

Furthermore, at least one servo motor 27 is provided on each of the stretching units 3 in order to slide the spreading fingers 23 away from or towards one another. In FIG. 3, the spreading fingers 23 are shown in an inner receiving position S1 for receiving the film sleeve 4 from the label dispenser 5. The film sleeve 4 put on over the spreading fingers 23 can, when the spreading fingers 23 are driven apart, be stretched apart at least so far that a container 6 that is to be labeled can be slid from below through the base plate 22 and between the spreading fingers 23.

The spreading fingers 23 are preferably slid with the help of a rotatable control disc 28 with curved control grooves 29. For this purpose, the control disc 28 is connected to a rotatable toothed wheel segment 30 or the like, which meshes with a toothed wheel 27*a* provided on the servo motor 27. By transferring the rotational movement of the servo motor 27 to the toothed wheel segment 30, additional levers, connecting members, activation arms and the like for driving the control disc 28 are dispensable. This allows a drive of the spreading fingers 23 that is both space-saving and exact.

The servo motors 27 are preferably controlled by the control unit 8. This allows individual activation of the individual servo motors 27, in particular independently of the rotational speed of the labeling carousel 2. It is consequently possible to optimize the time sequence particularly of the spreading movement of the spreading fingers 23, for example, their positioning speed, independently of the speed of the labeling carousel 2 and consequently of the machine performance of the device 1 according to the disclosure. In particular, it is possible to coordinate the time sequence of the spreading movement of the spreading fingers 23 with the transfer of the label sleeves 4 from the label dispenser 5 to the stretching units 3. For example, the speed with which the film sleeves 4 are shot over the spreading fingers 23 is given by the label dispenser 5 and is consequently essentially independent of the circulation speed of the labeling carousel 2. From the point of view of the stretching units 3, the horizontal movement with respect to the label dispenser 5 and the vertical movement of the film sleeves 4 moreover overlap. It is consequently desirable to be able to adapt the switching-on and switching-off times as well as the positioning speed of the servo motors 27 primarily to the time at which the film sleeves 4 are shot and to their speed as exactly and flexibly as possible, but, when required, also to take into account the respective circulation speed of the stretching units 3 when putting on the film sleeves 4.

It is also conceivable to combine different positioning speeds and travel directions of the servo motor 27 when putting on the film sleeves 4. For example, it is conceivable first to drive the spreading fingers 23 apart from one another until these touch against the film sleeves 4. Then the spreading fingers 23 could be driven back together again through a stipulated adjustment travel so that the touched film sleeve 4 detaches from the spreading fingers 23 and is brought from a possibly slanted or not completely covered position into a correct position with respect to the spreading fingers 23. Then the spreading fingers 23 can be driven apart from one another for stretching the film sleeve 4 until it has reached a stipulated outer spreading position S2 for labeling, as indicated in FIG. 6, for example. It would naturally be conceivable here to combine different phases of the application, alignment and stretching of the film sleeve 4. For example, the spreading fingers 23 could first be driven apart from one another and then back together a number of times, one after the other, in order to shake the film sleeve into its target position. Likewise it would be conceivable first to drive the spreading fingers 23 apart from one another, to hold them there for a stipulated time, and then to continue with the spreading movement of the spreading fingers 23. An alignment of the film sleeve 4 with respect to the spreading fingers 23 could also be brought about by such a pause in the movement of the spreading fingers 23. Putting on the film sleeve 4 can consequently be optimised by suitable activation of the servo motor 27 in diverse ways.

Likewise, the inner receiving position S1 of the spreading fingers 23, for example, as shown in FIG. 3, could be adapted to the characteristics of the film sleeve 4 and/or the containers 6. This is likewise true for the outer spreading position S2 of the spreading fingers 23 for labeling the containers 6. For example, the inner receiving position S1 and/or the outer spreading position S2 could be adapted to the dimensions and/or the elasticity of the film sleeve 4. Adaptation to the dimensions and shape of the containers 6 is likewise possible.

Figure 4:
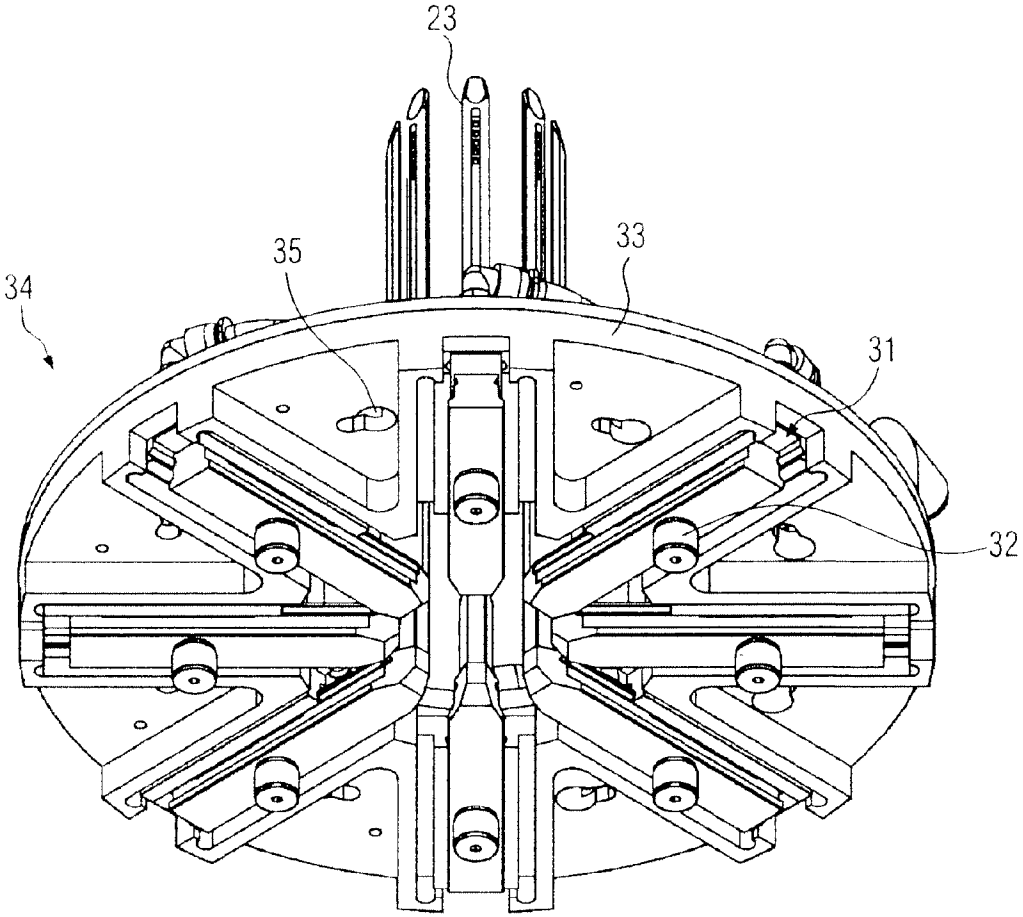
FIG. 4 a diagonal view of a drive section of the stretching unit according to the disclosure.

As indicated in FIG. 3, the conversion of the rotational movement of the servo motor 27 and the control disc 28 into a preferably radial spreading movement of the spreading fingers 23 takes place with the help of control grooves 29 that are formed preferably in a curved manner in the control disc 28. As FIG. 4 illustrates, provided as the counter piece for the control grooves 29 are radial guides 31 and control cams or rollers 32 that are permanently connected to the spreading fingers 23. The radial guides 31 are preferably provided on a guide plate 33 for radial guidance of the spreading fingers 23. The guide plate 33 and die spreading fingers 23 together constitute a quick-change unit 34 of the stretching unit 3, referred to hereinafter as a fitting unit 34.

Figure 5:
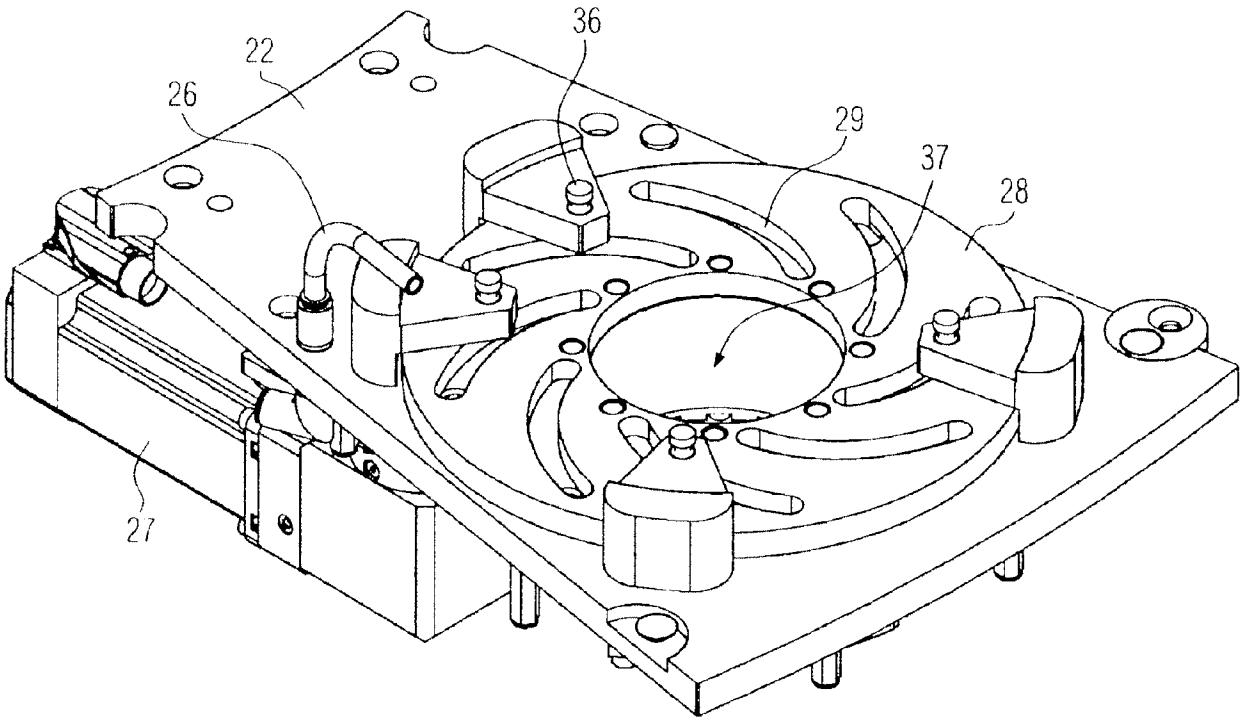
FIG. 5 a diagonal view of an exchangeable fitting section of the stretching unit from below.

For anchoring the fitting unit 34 on the assembly plate 22, for example, keyhole-shaped locking recesses 35 can be provided in the guide plate 33 and corresponding mushroom pins 36 can be provided on the base plate 22, as shown in FIG. 5 by way of example. The mushroom pins 36 can be slid through the locking openings 35 and the guide disc 33 can be locked on the base plate 22 by rotation in a known manner. It shall be understood that the locking openings 35 could also be provided on the base plate 22 and the mushroom pins 36 on the guide disc 33. Other quick-release mechanisms would also be conceivable. Crucial hereby is that the drive of the spreading fingers 23, particularly the servo motor 27 and the control disc 28, are permanently connected to or supported on the labeling carousel 2, whereas the spreading fingers 23 and the guide plate 33 are executed as the exchangeable and consequently flexibly interchangeable fitting unit 34. This allows an economical and time-saving adaptation of the device 1 according to the disclosure to different film sleeves 4 and/or containers 6. As FIG. 3 furthermore illustrates, the pressure lines 25 for the individual spreading fingers 23 are preferably likewise formed as a component of the fitting unit 34, so that only the shared pressure line 26 has to be connected for connecting the stretching unit 3 to the valve units 7 during a change of the fitting units 34.

As FIG. 5 furthermore illustrates, a central opening 37 is provided in the stretching unit 3, whereby the container 6 that is to be labelled can be lifted through this opening 37 and into the stretching unit 3. A container area 40 indicated in FIG. 6 for receiving the containers 6 to be labelled is defined by the central opening 37 and the area enclosed by the spreading fingers 23 in their outer spreading position S2. In other words, the container area 40 of the stretching unit 3 comprises an area within the spread spreading fingers 23 and the film sleeve 4 held by the spreading fingers 23. The spreading fingers 23 are consequently arranged around the container area 40 in their spreading position S2.

The interaction of the stretching unit 3, the film sleeve 4 and the container 6 during the labeling of the container 6 is described in the following using items I to X of FIG. 6, each of which shows a schematic partial section through a circumferential area of the labeling carousel 2 with a stretching unit 3. The stretching unit 3 thereby moves towards the observer. Items I to X correspond to different angular positions of the stretching unit 3 during one revolution of the labeling carousel 2. For the sake of simplicity, only two spreading fingers 23 are indicated schematically.

Item I of FIG. 6 shows the shooting of a film sleeve 4 on to the stretching unit 3 with the help of the stationary label dispenser 5, on which four transport rollers 5*a* for the feed motion of the film sleeve 4 are indicated. The functioning of the device 1 according to the disclosure is to be understood hereby such that a continual flow of containers 6 that are to be labelled, such as beverage bottles, for example, particularly made of PET, is transferred to the rotating labeling carousel 2. The film sleeves 4 are preferably rolled off of a supply roll as a tube and separated from this at the required length in the label dispenser 5. Label dispensers 5 of this kind are known from the state of the art and are therefore not explained in more detail. In Item I, the still unequipped positioning unit 16 and the removal unit 9 with the holding device 13 are likewise indicated.

Item II of FIG. 6 illustrates a state in which the film sleeve 4 has already been pulled over the spreading fingers 23. The spreading fingers 23 are hereby still located in the inner receiving position S1. A container 6 that is to be labeled is set on to the positioning device 16 by a feeding device 41 indicated by a clamp.

Item III of FIG. 6 shows a state in which the spreading fingers 23 are in an intermediate position between the inner receiving position S1 and the outer spreading position S2. The container 6 that is to be labeled is taken over by the guide device 17 and first fixed in place on the labeling carousel 2 under the stretching unit 3.

Item IV of FIG. 6 shows a state in which the spreading fingers 23 have reached the outer spreading position S2 around the container area 40 of the stretching unit 3, so that the guide device 17 can release the container 6 in the vertical direction. Although the container 6 is shown in Item IV in a not yet lifted position, the container 6 could already be lifted while the spreading fingers 23 are spreading, as long as the container 6 does not collide with them. The spreading fingers 23 are preferably supplied with negative pressure (not shown) after they have reached the outer spreading position S2 in order to fix the film sleeve 4 in place on the spreading fingers 23 in a required labeling position.

Item V of FIG. 6 shows a state after the release of the container guide 17 in which the container 6 that is to be labeled has already been lifted with the help of the positioning device 16 up to an area directly below the spreading fingers 23.

The container 6 with the positioning unit 16 is lifted farther through the opening 37 of the stretching unit 3 up into the container area 40, until a stipulated labeling position of the container 6, particularly of its outside surface 6*a* that is to be labelled, is reached with respect to the film sleeve 4. A state of this kind is shown in Item VI of FIG. 6. The relative position of the container 6 with respect to the film sleeve 4 hereby is only by way of example. Any outside surface areas of the container 6 can be labeled with the device 1 according to the disclosure.

After the correct vertical positioning of the container 6 with respect to the film sleeve 4, the spreading fingers 23 can be driven back together again from the outer spreading position S2. A state of this kind is shown in Item VII of FIG. 6. The negative pressure is preferably maintained hereby in order to stabilize the position of the film sleeve 4 on the spreading fingers 23. The spreading fingers 23 are preferably driven together so far that areas of the film sleeve 4 between the spreading fingers 23 come into contact with the outside surface 6*a* of the container 6 that is to be labeled, while the container 6 can still be drawn upwards between the spreading fingers 23. The gripping device 13 of the removal unit 9 was hereby already closed around the neck of the container 6, so that the container 6 can be drawn upwards out of the container area 40 of the stretching unit 3 by the lift of the removal unit 9. Preferably at the beginning of the lifting of the container 6 out of the container area 40, the negative pressure to the spreading fingers 23 is interrupted. Furthermore the valve units 7 are switched in such a way that the spreading fingers are provided with compressed air for supporting the container removal. In this way, an air cushion can be produced between the spreading fingers 23 and the film sleeve 4 in order to reduce the friction between the spreading fingers 23 and the film sleeve 4 during the removal of the container 6. During the transfer of the film sleeve 4 from the spreading fingers 23 on to the container 6, a greater static friction is preferably reached between the film sleeve 4 and the container 6 than between the spreading fingers 23 and the film sleeve 4. The film sleeve 4 can, however, also be tightly clamped on the container 6 by the holding device 13 so that the film sleeve 4 detaches from the spreading fingers 23 when the holding device 13 is lifted with the container 6.

As Item VIII of FIG. 6 illustrates, this results in the labeling of the container 6 with the film sleeve 4 so that the container 6 can be lifted out of the container area 40 between the spreading fingers 23 with the help of the removal device 9. As is furthermore illustrated in Item VIII, the spreading fingers 23 can thereby already be driven back together again and the positioning device 16 can be driven downwards.

Item IX of FIG. 6 shows a state during the transfer of the labeled container 6 to a removal unit 42 symbolized by a clamp. The spreading fingers have already reached their inner receiving position S1.

Item X of FIG. 6 shows a state in which the positioning unit 16 has also reached its original lower end position for receiving the next container 6, so that Item I of FIG. 6 could follow a suitable lowering of the holding device 13.

In this regard, it can be seen in Item I that the holding device 13 must possibly be driven very close along the label dispenser 5. This can greatly restrict the adaptation of the device 1 according to the disclosure to different container sizes and film types. This problem could be remedied, for example, with an optional variant in which each of the stretching units 3 is held radially in a manner that allows it to slide and is driven outwards only in an area of the label dispenser 5 as indicated by the arrow R. The circulating path of the spreading fingers 23 would then differ from a circular path in this section. The label dispenser 5 could consequently be arranged at a correspondingly greater distance to the holding devices 13 with an outward offset, in order to drive the stretching units 3 under the label dispenser 5 through at a greater radial distance. The radial adjustment of the stretching units 3 could, for example, be brought about with the help of separate servo motors. A corresponding cam controller would also be conceivable, however. A radial adjustment of the stretching units 3 over a circumferential subsection of the circulating path could, particularly with the described servo motor drive of the spreading fingers 23, be combined in an especially advantageous manner, because a complex overlap of a plurality of cam controllers would then not be necessary.

By means of suitable activation of the servo motors 27 of the stretching units 3, the provision of the film sleeves 4 to the stretching units 3 can be optimized. Special advantages result from the coordinated activation of the servo motors 27 of the stretching units 23 and the valve units 7, particularly also with respect to the time at which the negative pressure is switched on. In this way, it can be guaranteed that the film sleeve 4 is positioned correctly with respect to the spreading fingers 23 and is fixed in place on these in the correct position. Special advantages likewise result from the fact that the time at which the positive pressure is switched on is coordinated with the beginning of the lifting movement of the removal unit 9. This makes it possible to achieve a coordinated activation of the servo motors 12 of the removal units 9 and the valve units 7. It is especially advantageous hereby that the coordinated activation of the servo motors 12, 27 and the valve units 7 can take place independently of the rotational speed and consequently the machine performance of the device 1 according to the disclosure.

The activation of the servo motors 27 of the stretching units 3, the servo motors 12 of the removal units 9 and/or the valve units 7 can furthermore be adapted to changing requirements discretionarily by means of programming. For example, it is possible to adapt the corresponding control parameters to different label types. The film sleeves 4 used for labeling the containers 6 could, for example, differ with respect to the elasticity of the film sleeves 4 and/or in the forces that arise during the stretching. The film sleeves could, for example, have an elastic expansibility of at least 50%. The film sleeves 4 are preferably labels, but could also be applied to the containers 6 for a different purpose.

Further advantages result from the fact that the spreading fingers 23 can be executed as a component of an exchangeable fitting unit 34 of the stretching units 3. In this way the device 1 according to the disclosure can be adapted to different labels and container types with a comparatively low material expenditure. To this end, the spreading fingers 23 could also be provided with exchangeable adapter pieces 43 that are indicated with dashed lines in Item X of FIG. 6 only for the purpose of a better understanding. The adapter pieces 43 are preferably provided as adapters on the outer side of the spreading fingers 23. The adapter pieces 43 could be attached to the spreading fingers 23 by plugging and/or clipping them on for a simple exchange. As indicated in FIG. 6, the adapter pieces 43 preferably differ in the length of the spreading fingers 23. If required, surface structures, for example, grooves, that differ from the spreading fingers 23 can be provided on the adapter pieces 43. It would likewise be possible to lengthen the air openings 24 of the spreading fingers 23 with the help of suitable channels into the adapter pieces 43. The adapter pieces 43, however, are particularly used to adapt the length of the spreading fingers to shorter film sleeves 4 without having to exchange the fitting unit 34. The adapter pieces 43 consequently allow an adaptation of the device 1 according to the disclosure in an especially economical manner.

The use of additional guide plates 44 or the like in the area of the stretching units 3 would also be conceivable. For the sake of simplicity, such a guide plate 44 is only indicated schematically in Item IX of FIG. 6. In general, such guide plates 44 could be used to stabilise the film sleeve 4 in a certain position while it is pulled over the spreading fingers 23, for example in a certain rotational position. It shall be understood here that in this case, the guide plates 44 must be arranged in such a way that they do not collide with the spreading fingers 23. For example, the guide plates 44 could be arranged in areas between the spreading fingers 23 for this purpose. It can be sufficient hereby to form the guide plates 44 such that they do not entirely surround the container area 40 of the stretching units 3, but instead only in circumferential sub-areas.

The invention claimed is:

1. A device for applying elastic film sleeves to containers, comprising:

a plurality of revolving stretching units for receiving and stretching the film sleeves in such a way that the containers can be slid into the film sleeves, each of the stretching units comprising a container area for receiving a container as well as a plurality of movable spreading fingers that are distributed around the circumference of the container area and that are for stretching the film sleeves away from one another, and, for producing at least a relative movement of the film sleeve and container with respect to one another in a radial direction, at least one servo motor drive is provided per stretching unit, the at least one servo motor driving the spreading fingers;

at least one label dispenser for equipping the stretching units with the film sleeves; and a control device for activating the at least one servo motor in such a way that the spreading fingers are moved between an inner receiving position (S1) for receiving the film sleeves and an outer spreading position (S2) for spreading the film sleeves, and for coordinating the time sequence of a spreading movement of the spreading fingers with the transfer of the label sleeves from the label dispenser to the stretching units.

2. The device according to claim 1, and a control device for activating the at least one servo motor in such a way that at least one of a switching-on time, a positioning speed, and a combination thereof of the at least one servo motor can be adjusted with the help of the control device.

3. The device according to claim 2, wherein the adjustment of the at least one servo motor with the help of the control device is to move the spreading fingers away from one another.

4. The device according to claim 1, and positioning units revolving below the stretching units for positioning the containers in the container areas.

5. The device according to claim 4, wherein an upper end position of the positioning units can be adjusted for aligning the containers with respect to the label sleeves.

6. The device according to claim 5, wherein the upper end position is adjusted in steps of not more than 1 mm.

7. The device according to claim 4, and wherein each of the positioning units comprises lifting devices driven by a servo motor for lifting the containers into the container areas.

8. The device according to claim 1, and removal units revolving above the stretching units for removing the containers from the container areas.

9. The device according to claim 8, and wherein each of the removal units comprises lifting devices driven by a servo motor for lifting the containers out of the container areas.

10. The device according to claim 8, and revolving valve units for switching in an alternating manner a negative pressure or a positive pressure to the spreading fingers in order to suction in the film sleeves or repel them from the spreading fingers, wherein the valve units are formed to supply the negative pressure or the positive pressure to the stretching units independently of one another.

11. The device according to claim 10, wherein the switching times of one of the positive pressure, the negative pressure, and a combination thereof are adjustable.

12. The device according to claim 11, and wherein a switching-on time of the negative pressure can be synchronized with the activation of the at least one servo motor of the assigned stretching unit.

13. The device according to claim 8, wherein a switching-on time of the positive pressure can be synchronized with the removal units.

14. The device according to claim 10, wherein the valve units comprise Venturi nozzles for producing the negative pressure.

15. The device according to claim 1, and an exchangeable fitting section is provided on each stretching unit and wherein the fitting section comprises at least the stretching fingers and a guide plate for guiding the stretching fingers.

16. The device according to claim 1, and exchangeable adapter pieces are provided on the outer sides of the spreading fingers.

17. The device according to claim 16, and wherein the adapter pieces adapt the spreading fingers to film sleeves of the stipulated length.

18. The device according to claim 1, and guide plates are provided on the stretching units in order to counteract a rotation of the film sleeves with respect to the stretching units.

19. A method for applying elastic film sleeves to containers with a device according to claim 1, comprising:

a) Receiving the film sleeves with the stretching units;

b) Stretching the film sleeves in such a way that the containers can be slid into the film sleeves; and c) Sliding the containers into the film sleeves, wherein the spreading fingers are moved in at least one of the Steps a) to c) depending on an adjustable time interval, the beginning of which is coupled to a time of the dispensing of the film sleeves.

20. The method according to claim 19, wherein Step a) comprises an alignment Step a1) in which the spreading fingers are moved away from one another and then back towards one another at least one time in order to align the position of the film sleeves with respect to the spreading fingers.

21. The device according to claim 1, and wherein one of the inner receiving positions, the outer spreading position, and a combination thereof can be adjusted with the help of the control device.

* * * * *